US009299301B2

(12) United States Patent
Choi et al.

(10) Patent No.: US 9,299,301 B2
(45) Date of Patent: Mar. 29, 2016

(54) DISPLAY DEVICE AND METHOD FOR DRIVING THE DISPLAY DEVICE

(75) Inventors: Yong-Jun Choi, Asan-si (KR); Jae-Suk Choi, Uijcongbu-si (KR); Po-Yun Park, Seoul (KR); Jung Hwan Cho, Asan-si (KR); Min Joo Lee, Seoul (KR)

(73) Assignee: SAMSUNG DISPLAY CO., LTD. (KR)

( * ) Notice: Subject to any disclaimer, the term of this patent is extended or adjusted under 35 U.S.C. 154(b) by 755 days.

(21) Appl. No.: 13/423,101

(22) Filed: Mar. 16, 2012

(65) Prior Publication Data

US 2013/0113811 A1 May 9, 2013

(30) Foreign Application Priority Data

Nov. 4, 2011 (KR) ..... 10-2011-0114750

(51) Int. Cl.
*G09G 3/36* (2006.01)
*G09G 3/20* (2006.01)

(52) U.S. Cl.
CPC ..... *G09G 3/3648* (2013.01); *G09G 3/20* (2013.01); *G09G 3/3655* (2013.01); *G09G 2300/0809* (2013.01); *G09G 2300/0876* (2013.01); *G09G 2320/10* (2013.01); *G09G 2330/021* (2013.01); *G09G 2340/0435* (2013.01); *G09G 2360/18* (2013.01)

(58) Field of Classification Search
CPC ..... G06F 3/044; G06F 3/0412; G06F 3/0416
See application file for complete search history.

(56) References Cited

U.S. PATENT DOCUMENTS

| | | | | |
|---|---|---|---|---|
| 6,005,542 | A | 12/1999 | Yoon | |
| 7,102,604 | B2 | 9/2006 | Hong | |
| 7,112,996 | B2 | 9/2006 | Lee | |
| 7,362,295 | B2 | 4/2008 | Park et al. | |
| 7,489,295 | B2 | 2/2009 | Honbo | |
| 7,545,354 | B2 | 6/2009 | Ha et al. | |
| 7,545,654 | B2 | 6/2009 | Berghegger | |
| 7,580,032 | B2 | 8/2009 | Jung et al. | |
| 7,612,505 | B2 | 11/2009 | Min et al. | |
| 7,724,218 | B2 | 5/2010 | Kim et al. | |
| 7,907,106 | B2 | 3/2011 | Shin et al. | |
| 8,692,823 | B2 * | 4/2014 | Toyotaka et al. | 345/212 |
| 2001/0024187 | A1 | 9/2001 | Sato et al. | |
| 2002/0067332 | A1 | 6/2002 | Hirakata et al. | |
| 2003/0030607 | A1 | 2/2003 | Kitagawa et al. | |

(Continued)

FOREIGN PATENT DOCUMENTS

| | | |
|---|---|---|
| CN | 101188105 | 5/2008 |
| EP | 0838801 | 4/1998 |

(Continued)

*Primary Examiner* — Kenneth B Lee, Jr.
(74) *Attorney, Agent, or Firm* — Innovation Counsel LLP

(57) ABSTRACT

A display device includes a display panel for displaying a still image and for displaying a motion picture. The display panel includes a gate line, a data line, a storage electrode line, a first switching element connected to the gate line and the date line, a storage connected to the switching element and the storage electrode line. The display device further includes a signal controller for providing controlling signals to drive the display panel. The display panel is driven at a first frequency when the motion picture is displayed. The display panel is driven at a second frequency lower than the first frequency when the still image is displayed. When the display panel is driven at the second frequency, a common voltage inputted to the storage electrode line changes.

20 Claims, 7 Drawing Sheets

(56) References Cited

U.S. PATENT DOCUMENTS

| | | | | |
|---|---|---|---|---|
| 2004/0169627 | A1 | 9/2004 | Hong | |
| 2004/0179002 | A1 | 9/2004 | Park et al. | |
| 2005/0068289 | A1 | 3/2005 | Diefenbaugh et al. | |
| 2005/0219196 | A1 | 10/2005 | Lee | |
| 2005/0253798 | A1 | 11/2005 | Hiyama et al. | |
| 2006/0038771 | A1 | 2/2006 | Hirakata et al. | |
| 2007/0091204 | A1 | 4/2007 | Koshimizu et al. | |
| 2007/0103424 | A1 | 5/2007 | Huang | |
| 2007/0132683 | A1 | 6/2007 | Kong | |
| 2007/0139427 | A1 | 6/2007 | Sahashi | |
| 2007/0176883 | A1 | 8/2007 | Hsu et al. | |
| 2008/0079701 | A1 | 4/2008 | Shin et al. | |
| 2008/0084379 | A1 | 4/2008 | Takahashi et al. | |
| 2008/0100553 | A1 | 5/2008 | Shen et al. | |
| 2008/0117223 | A1 | 5/2008 | Mayer et al. | |
| 2008/0224983 | A1 | 9/2008 | Lee et al. | |
| 2009/0096769 | A1 | 4/2009 | Kim et al. | |
| 2009/0244112 | A1 | 10/2009 | Jung et al. | |
| 2010/0165145 | A1 | 7/2010 | Kuroki | |
| 2010/0238193 | A1 | 9/2010 | Neal et al. | |
| 2010/0302265 | A1 | 12/2010 | Sumi | |
| 2011/0025910 | A1 | 2/2011 | Furukawa et al. | |
| 2011/0148826 | A1* | 6/2011 | Koyama et al. | 345/204 |
| 2011/0157253 | A1 | 6/2011 | Yamazaki et al. | |
| 2011/0227955 | A1 | 9/2011 | Lee et al. | |
| 2012/0268446 | A1 | 10/2012 | Yamauchi | |
| 2012/0320004 | A1 | 12/2012 | Kitakado | |
| 2013/0027379 | A1 | 1/2013 | Lee et al. | |

FOREIGN PATENT DOCUMENTS

| | | | |
|---|---|---|---|
| JP | 06-267660 | A | 9/1994 |
| JP | 06-333695 | A | 12/1994 |
| JP | 07-191298 | | 7/1995 |
| JP | 09-101506 | | 4/1997 |
| JP | 10-111490 | A | 4/1998 |
| JP | 2001-013930 | | 1/2001 |
| JP | 2004-061782 | A | 2/2004 |
| JP | 2005-091385 | A | 4/2005 |
| JP | 2005-234032 | A | 9/2005 |
| JP | 3718832 | | 9/2005 |
| JP | 2006-073199 | A | 3/2006 |
| JP | 2006-091242 | A | 4/2006 |
| JP | 2006-228312 | | 8/2006 |
| JP | 2007-039759 | A | 2/2007 |
| JP | 2007-267038 | A | 10/2007 |
| JP | 2008-098710 | A | 4/2008 |
| JP | 2009-069373 | A | 4/2009 |
| JP | 2009-075580 | A | 4/2009 |
| JP | 2010-066725 | A | 3/2010 |
| JP | 4469788 | | 3/2010 |
| JP | 4586052 | | 9/2010 |
| JP | 2010-273259 | A | 12/2010 |
| KR | 10-2002-0072504 | A | 9/2002 |
| KR | 10-0374375 | | 2/2003 |
| KR | 10-0400595 | | 9/2003 |
| KR | 10-0480815 | | 3/2005 |
| KR | 10-2006-0058421 | A | 5/2006 |
| KR | 10-2006-0066424 | | 6/2006 |
| KR | 10-2007-0039759 | A | 4/2007 |
| KR | 10-2007-0066013 | A | 6/2007 |
| KR | 10-2007-0076078 | A | 7/2007 |
| KR | 10-0767868 | | 10/2007 |
| KR | 10-0770543 | | 10/2007 |
| KR | 10-2008-0002427 | A | 1/2008 |
| KR | 10-2008-0035333 | A | 4/2008 |
| KR | 10-0834119 | | 5/2008 |
| KR | 10-0840331 | | 6/2008 |
| KR | 10-0848953 | | 7/2008 |
| KR | 10-2010-0131671 | A | 12/2010 |
| KR | 10-2011-0070178 | A | 6/2011 |
| KR | 10-2013-0012381 | A | 7/2011 |

* cited by examiner

DISPLAY DEVICE AND METHOD FOR DRIVING THE DISPLAY DEVICE

CROSS-REFERENCE TO RELATED APPLICATION

This application claims priority to and the benefit of Korean Patent Application No. 10-2011-0114750 filed in the Korean Intellectual Property Office on Nov. 4, 2011, the entire contents of which are incorporated herein by reference.

BACKGROUND OF THE INVENTION (a) Field of the Invention

The present invention relates to a display device and a driving method thereof, and more particularly, to a display device capable of reducing power consumption and preventing flicker from being recognized and to a method for driving the display device.

(b) Description of the Related Art

Currently, display devices are required for computer monitors, televisions, mobile phones, and many other widely-used electronic devices. For example, a display device may be a cathode ray tube display device, a liquid crystal display device, or a plasma display device.

The display device typically includes a graphic processing unit (GPU), a display panel, and a signal controller. The graphic processing unit transmits image data to the signal controller; the signal controller generates a control signal for driving the display panel and transmits the control signal together with the image data to the display panel, thereby driving the display device.

Images displayed on the display panel may be classified into still images and motion pictures. The display panel typically displays several frames per second. If the image data included in the frames are the same, a still image is displayed. On the other hand, if the frames include different image data, a motion picture is displayed.

Since the signal controller receives image data from the graphic processing unit for every frame even when the same image data has been received in the previous frame, unnecessary power consumption is incurred.

Recently, methods for reducing the power consumption of the display device have been researched. According to an example method, the image data of a still image is stored in a frame memory that is implemented in the signal controller, and the stored image data is provided to the display panel for displaying the still image. Since the image data does not need to be repeatedly received from the graphic processing unit for displaying the still image, power consumption related to the operation of the graphic processing unit may be reduced.

Nevertheless, for implementing this method, the operation of the additional frame memory may require additional power consumption, which may substantially reduce the benefit of this method.

The above information disclosed in this Background section is only for enhancement of understanding of the background of the invention. This Background section may contain information that does not form the prior art that is already known in this country to a person of ordinary skill in the art.

SUMMARY OF THE INVENTION

Embodiments of the present invention are related to display devices and associated driving methods having advantages of reducing power consumption and preventing conspicuous flicker.

An embodiment of the invention is related to a display device that includes a display panel for displaying a still image and for displaying a motion picture. The display panel may include a gate line, a data line, a storage electrode line, a first switching element connected to the gate line and the date line, a storage connected to the switching element and the storage electrode line. The display device may further include a signal controller for providing controlling signals to drive the display panel. The display panel is driven at a first frequency when the motion picture is displayed. The display panel is driven at a second frequency lower than the first frequency when the still image is displayed. When the display panel is driven at the second frequency, a common voltage inputted to the storage electrode line changes values.

The display device may further include a graphic processing unit for transmitting a still image start signal to the signal controller and for transmitting a still image end signal to the signal controller.

In one or more embodiments, the signal controller may include a frame memory for storing a first set of input image data transmitted from the graphic processing unit as stored image data, the signal controller may output the stored image data to the display panel at the second frequency, and the signal controller may inactivate transmission of further input image data when the signal controller receives the still image start signal.

In one or more embodiments, the signal controller may activate transmission of a second set of input image data and may output the second set of input image data to the display panel at the first frequency when the signal controller receives the still image end signal.

In one or more embodiments, the display panel may further include a second switching element and a third switching element connected between the storage electrode line and the storage capacitor, and may further include a storage electrode control line. Each of the second switching element and the third switching element may include a control terminal, an input terminal, and an output terminal. The input terminals of the second switching element and the third switching element may be connected to the storage electrode line. The output terminals of the second switching element and the third switching element may be connected to the storage capacitor. The control terminal of the second switching element may be connected to the gate line. The control terminal of the third switching element may be connected to the storage electrode control line.

In one or more embodiments, when the display panel is driven at the second frequency, the common voltage may have a first voltage value in a first period and may have a second voltage value higher than the first voltage value in a second period.

In one or more embodiments, the first period may correspond to a frame, and the second period may correspond to a vertical blank period between two adjacent frames.

In one or more embodiments, a control voltage inputted to the storage electrode control line may have a gate-off voltage value in the first period and may have a gate-on voltage value in the second period.

In one or more embodiments, when the display panel is driven at the second frequency, the common voltage may have a third voltage value higher than the second voltage value in a third period. The first period corresponds to a frame. The second period and the third period may be within a time period that corresponds to a vertical blank period between two adjacent frames.

In one or more embodiments, when the display panel is driven at the second frequency, the common voltage may have a first voltage value in a first period, may change from having the first voltage value to having a second voltage value higher than the first voltage value (one or more times) in a second period, and may change from having the second voltage value to having the first voltage value (one or more times) in the second period.

In one or more embodiments, when the common voltage is changed from having the first voltage value to having the second voltage value, the common voltage may have a value between the first voltage value and the second voltage value and may be gradually changed.

An embodiment of the present invention is related to a method for driving a display device. The method may include receiving a first set of input image data. The method may further include driving a display panel at a first frequency. The method may further include receiving a still image start signal. The method may further include, after the receiving the still image start signal, driving the display panel at a second frequency lower than the first frequency. The method may further include providing a common voltage to the display panel, wherein the common voltage changes when the display panel is driven at the second frequency. The method may further include receiving a still image end signal. The method may further include, after the receiving the still image end signal, driving the display panel at the first frequency.

In one or more embodiments, the method may further include storing the first set of input image data in a frame memory as stored image data. The method may further include, after the receiving the still image start signal, inactivating transmission of further input image data. The method may further include, after the receiving the still image start signal, outputting the stored image data stored to the display panel at the second frequency.

In one or more embodiments, the method may further include, after the receiving the still image end signal, activating transmission of second set of input image data. The method may further include, after the receiving the still image end signal, outputting the second set of input image data to the display panel at the first frequency.

In one or more embodiments, the common voltage may have a first voltage value in a first period and may have a second voltage value higher than the first voltage value in a second period.

In one or more embodiments, the first period may correspond to a frame, and the second period may correspond to a vertical blank period between two adjacent frames.

In one or more embodiments, the common voltage may have a third voltage value higher than the second voltage value in a third period.

In one or more embodiments, the common voltage may have a first voltage value in a first period, may change from having the first voltage value to having a second voltage higher than the first voltage in a second period, and may change from having the second value to having the first value in the second period.

In one or more embodiments, when the common voltage is changed from having the first voltage value to having the second voltage value, the common voltage may have a value between the first voltage value and the second voltage value and may be gradually changed. According to embodiments of the present invention, the display panel is driven at the first frequency when the motion picture is displayed, and the display panel is driven at the second frequency lower than the first frequency when the still image is displayed, such that it is possible to reduce power consumption.

Further, when the display panel is driven at the second frequency, the common voltage is changed to change luminance, such that the cycle of luminance change may be sufficiently short to prevent flicker from being recognized.

DETAILED DESCRIPTION OF THE EMBODIMENTS

Figure 1:
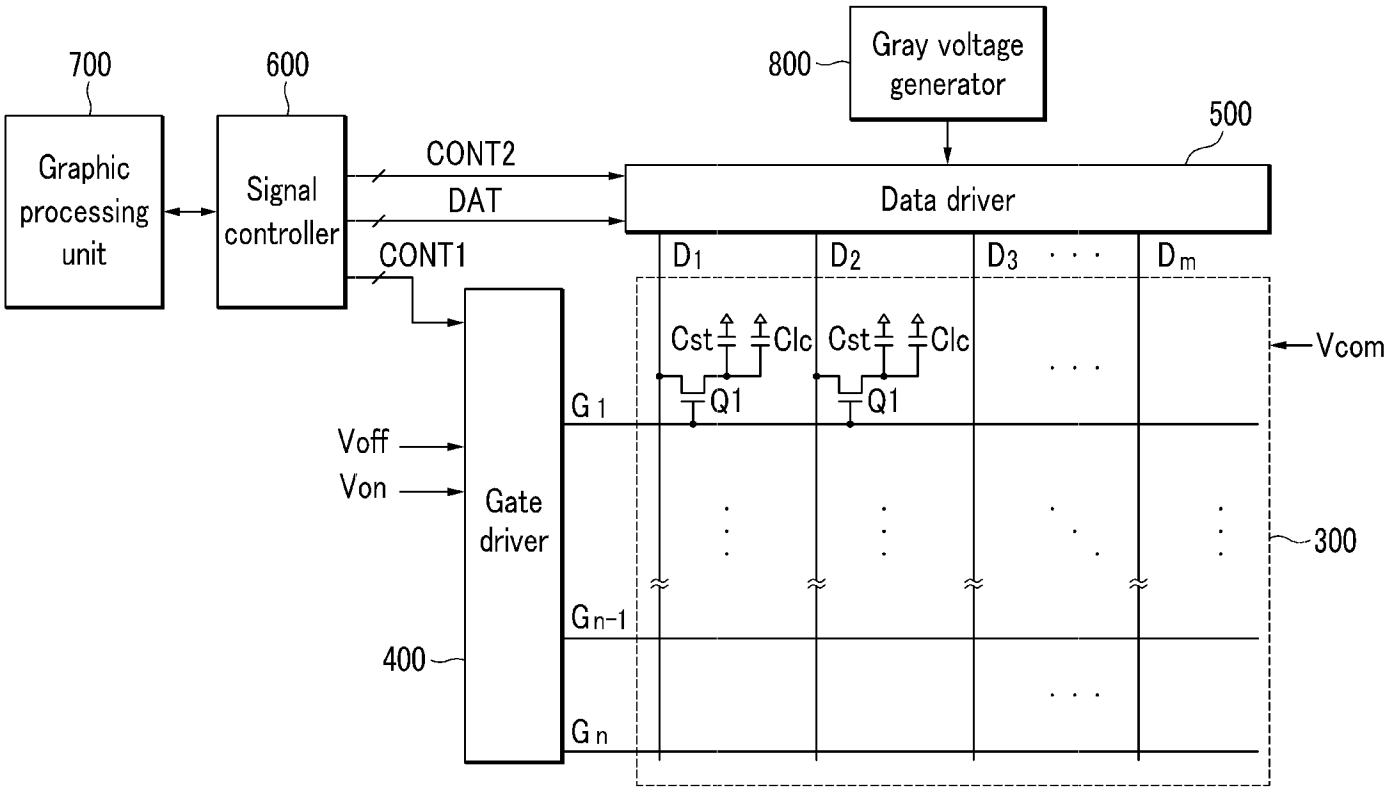
FIG. 1 is a block diagram illustrating a display device according to an embodiment of the present invention.

The present invention will be described more fully hereinafter with reference to the accompanying drawings, in which embodiments of the invention are shown. As those skilled in the art would realize, the described embodiments may be modified in various different ways, all without departing from the spirit or scope of the present invention.

In the drawings, the thickness of layers, films, panels, regions, etc., may be exaggerated for clarity. Like reference numerals may designate like elements throughout the specification. It will be understood that when an element such as a layer, film, region, or substrate is referred to as being "on" another element, it can be directly on the other element, or intervening elements may also be present. In contrast, when an element is referred to as being "directly on" another element, there are no intervening elements present.

A display device according to an embodiment of the present invention will be described below with reference to the accompanying drawings.

FIG. 1 is a block diagram illustrating a display device according to an embodiment of the present invention.

As shown in FIG. 1, the display device includes a display panel 300 for displaying an image, a signal controller 600 controlling signals for driving the display panel 300, and a graphic processing unit 700 transmitting input image data to the signal controller 600.

The display panel 300 may receive image data DAT from the signal controller 600 to display still images and/or motion pictures. If the image data DAT for all the frames in a plurality of sequential frames are the same, a still image may be displayed. On the other hand, if frames in the plurality of sequential frames have different image data DAT, a motion picture may be displayed.

The display panel 300 includes a plurality of gate lines G1-Gn and a plurality of data lines D1-Dm. The plurality of gate lines G1-Gn may extend in a horizontal direction. The plurality of data lines D1-Dm may extend in a vertical direction and cross the plurality of gate lines G1-Gn.

One gate line among the plurality of gate lines G1-Gn and one data line among the plurality of data lines D1-Dm are connected with one pixel, and a first switching element Q1 connected with the gate line and the data line is included in the pixel. The first switching element Q1 includes a control terminal connected to the gate line, an input terminal connected with the data line, and an output terminal connected with a liquid crystal capacitor Clc and a storage capacitor Cst.

The display panel 300 of FIG. 1 is shown as a liquid crystal panel, but the present invention is not limited thereto and may use various display panels.

The signal controller 600 processes input image data and control signals thereof so as to be suitable for the operation condition of the liquid crystal panel 300 in response to the input image data received from the graphic processing unit 700 and the control signals thereof. The control signals may include, for example, a vertical synchronization signal Vsync, a horizontal synchronization signal Hsync, a main clock signal MCLK, and a data enable signal DE. The signal controller 600 generates and outputs a gate control signal CONT1 and a data control signal CONT2.

The gate control signal CONT1 includes a vertical synchronization start signal STV instructing an output start of a gate-on pulse (a high-level period of a gate signal GS) and includes a gate clock signal CPV controlling an output time of the gate-on pulse.

The data control signal CONT2 includes a horizontal synchronization start signal STH instructing an input start of the image data DAT and includes a load signal TP instructing application of the corresponding data voltage to the data lines D1-Dm.

The graphic processing unit 700 transmits the input image data to the signal controller 600. When the display panel 300 displays the motion picture, the graphic processing unit 700 transmits the input image data to the signal controller 600 for every frame. When the display panel 300 displays the still image, since the signal controller 600 stores the input image data received from the graphic processing unit 700 to transmit the input image data to the display panel 300, the graphic processing unit 700 does not transmit the input image data to the signal controller 600. That is, when the display panel 300 displays the still image, the graphic processing unit 700 is inactivated.

The graphic processing unit 700 transmits a still image start signal to the signal controller 600 at the conversion time when the input image data for displaying the motion picture is transmitted and then, the input image data for displaying the still image is transmitted. Further, the graphic processing unit 700 transmits a still image end signal to the signal controller 600 at the conversion time when the input image data for displaying the still image is transmitted and then, the input image data for displaying the motion picture is transmitted.

The display device according to the embodiment of the present invention may further include a gate driver 400 driving the gate lines G1-Gn and a data driver 500 driving the data lines D1-Dm.

The plurality of gate lines G1-Gn of the display panel 300 are connected to the gate driver 400, and the gate driver 400 alternately applies gate-on voltages Von and gate-off voltages Voff to the gate lines G1-Gn according to the gate control signal CONT1 applied from the signal controller 600.

The plurality of data lines D1-Dm of the display panel 300 are connected to the data driver 500, which receives the data control signal CONT2 and the image data DAT from the signal controller 600. The data driver 500 converts the image data DAT into data voltage using a gray voltage generated from a gray voltage generator 800 and transfers the converted data voltage to the data lines D1-Dm.

Next, a signal controller of a display device according to an embodiment of the present invention will be described.

Figure 2:
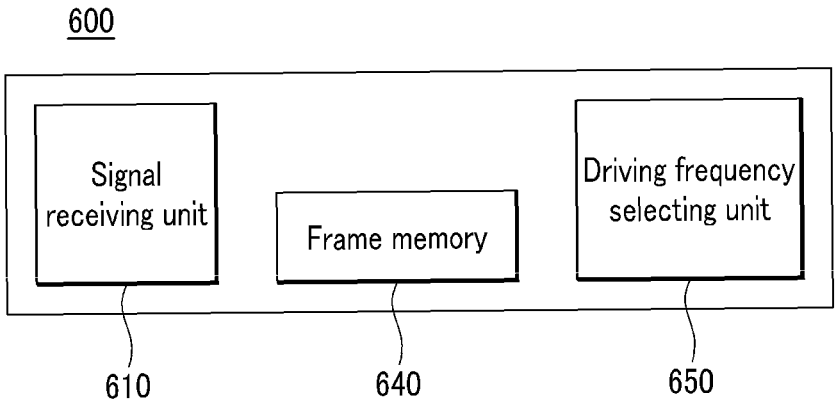
FIG. 2 is a block diagram illustrating a signal controller of a display device according to an embodiment of the present invention.

FIG. 2 is a block diagram illustrating the signal controller 600 of the display device according to an embodiment of the present invention.

The signal controller 600 may include a signal receiving unit 610 receiving various signals from the graphic processing unit 700, a frame memory 640 storing the input image data, and a driving frequency selecting unit 650 selecting a first frequency when a motion picture is displayed and selecting a second frequency when a still image is displayed.

The signal receiving unit 610 receives the input image data, the still image start signal, and the still image end signal from the graphic processing unit 700. Although not shown, the signal receiving unit 610 is connected with the graphic processing unit 700 through a main link and a sub link. The signal receiving unit 610 receives the input image data from the graphic processing unit 700 through the main link. Further, the signal receiving unit 610 receives the still image start signal and the still image end signal from the graphic processing unit 700 through the sub link and transmits a signal for notifying a driving state of the display panel 300 (illustrated in the example of FIG. 1) to the graphic processing unit 700 (through the sub link).

The frame memory 640 receives and stores the input image data from the signal receiving unit 610. When the display panel 300 displays a motion picture, the frame memory 640 is not used. When the display panel displays a still image, the input image data is stored in the frame memory 640, and the stored image data stored in the frame memory 640 is outputted to the display panel 300.

The driving frequency selecting unit 650 selects the first frequency when the display panel 300 displays a motion picture and selects the second frequency when the display panel 300 displays a still image. When a motion picture is displayed, the input image data is received from the signal receiving unit 610 to be outputted to the display panel 300 at the first frequency. When a still image is displayed, the stored image data is received from the frame memory 640 to be outputted to the display panel 300 at the second frequency.

In one or more embodiments, the second frequency has a value lower than the first frequency.

For example, the first frequency may be 60 Hz, which means that 60 frames are reproduced per second and displayed on the screen. Further, the second frequency may be 10 Hz, which means that 10 frames are reproduced per second and displayed on the screen.

Next, a display panel of a display device according to an embodiment of the present invention will be described.

Figure 3:
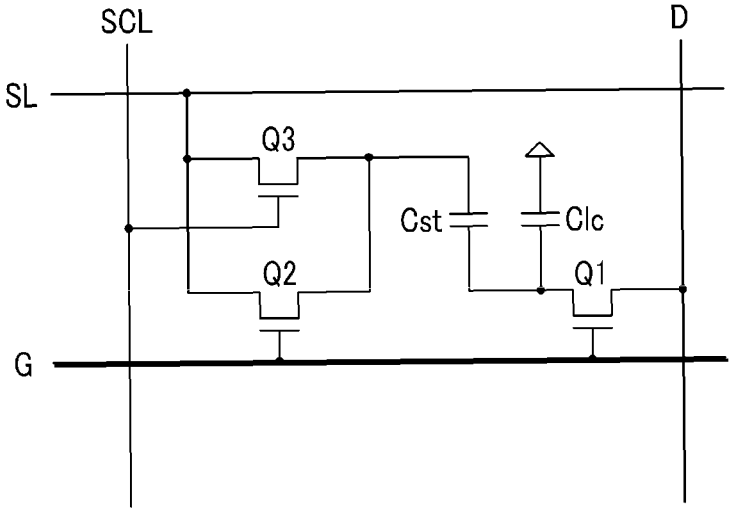
FIG. 3 is an equivalent circuit diagram for a pixel of a display device according to an embodiment of the present invention.

FIG. 3 is an equivalent circuit diagram for one pixel of a display device according to an embodiment of the present invention.

In the display panel of the display device according to the embodiment of the present invention, as shown in FIG. 3, a pixel is defined by crossing a gate line G and a data line D. Although not shown by omitting a layout view and a cross-sectional view, the gate line G and the data line D may be formed on a substrate and formed on different layers so as to be separated from each other. As shown in FIG. 1, the gate line G and the data line D may be in plural, but in FIG. 3, since only one pixel is shown, one gate line G and one data line D are shown.

A switching element Q1 is connected with the gate line G and the data line D. The first switching element Q1 is a three-terminal element such as a thin film transistor that includes a control terminal connected with the gate line G, an input terminal connected with the data line D, and an output terminal connected with a liquid crystal capacitor Clc and a storage capacitor Cst.

A storage electrode line SL and a storage electrode control line SCL may be further formed on the substrate. The storage electrode line SL and the storage capacitor Cst are connected to each other by a second switching element Q2 and a third switching element Q3. That is, the second switching element Q2 and the third switching element Q3 are connected between the storage electrode line SL and the storage capacitor Cst. The storage capacitor Cst includes a first terminal electrically connected to the switching element Q1; the storage capacitor further includes a second terminal connected between the first terminal and the storage line SL.

The second switching element Q2 is a three-terminal element such as a thin film transistor that includes a control terminal connected with the gate line G, an input terminal connected with the storage electrode line SL, and an output terminal connected with the storage capacitor Cst.

The third switching element Q3 is a three-terminal element such as a thin film transistor that includes a control terminal connected with the storage electrode control line SCL, an input terminal connected with the storage electrode line SL, and an output terminal connected with the storage capacitor Cst.

Hereinafter, a voltage relationship when a still image is displayed on the display panel of the display device according to an embodiment of the present invention will be described below.

Figure 4:
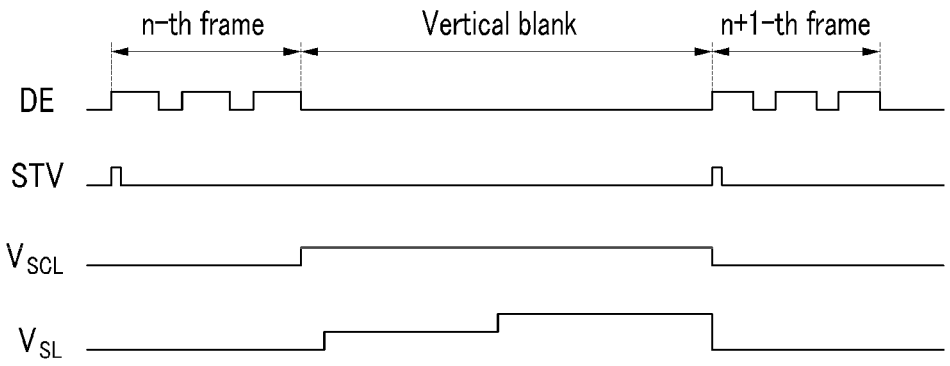
FIG. 4 is a diagram illustrating control signals for displaying a still image on a display panel of a display device according to an embodiment of the present invention.

FIG. 4 is a diagram illustrating control signals when a still image is displayed on a display panel of a display device according to an embodiment of the present invention.

In the display device according to an embodiment of the present invention, when a motion picture is displayed, the display panel is driven at a first frequency, and when a still image is displayed, the display panel is driven at a second frequency lower than the first frequency. In one or more embodiments, in order to implement the second frequency, a length of a vertical blank period associated with the second frequency may be larger than a length of a vertical blank period associated with the first frequency. A vertical blank period is the time difference between the last line of one frame and the beginning of the first line of the next frame.

For example, in order to change the driving frequency from 60 Hz to 10 Hz, a length of the vertical blank period between two adjacent frames may be changed to five times the length of one frame instead of a length substantially shorter than the length of one frame. In this case, speeds for applying a data enable signal DE in both the driving at 60 Hz and the driving at 10 Hz are the same as each other.

When a still image is displayed by driving the display panel at the second frequency, first, if a gate-on voltage is applied to the gate line G in the n-th frame, the first switching element Q1 and the second switching element Q2 are turned on. Next, if a data voltage is applied to the data line D, the liquid crystal capacitor Clc and the storage capacitor Cst are charged through the first switching element Q1.

A first terminal of the storage capacitor Cst is connected with the first switching element Q1 to receive the data voltage, and a second terminal is connected with the second switching element Q2 to receive the common voltage $V_{SL}$ applied to the storage electrode line SL. For the n-th frame in which the data enable signal is applied, the common voltage $V_{SL}$ has a predetermined value.

After the data voltage is applied to each pixel, the gate-off voltage is applied to the gate line G, and, in response, the first switching element Q1 and the second switching element Q2 are turned off. Subsequently, the vertical blank period starts, and the gate-on voltage is applied to the storage electrode control line SCL. Accordingly, the third switching element Q3 connected to the storage electrode control line SCL is turned on, and the common voltage is applied from the storage electrode line SL to the storage capacitor Cst.

In the vertical blank period, the common voltage $V_{SL}$ has voltage higher than the common voltage $V_{SL}$ of the n-th frame. When the common voltage $V_{SL}$ of the n-th frame has the first voltage, after the vertical blank period has started, the common voltage $V_{SL}$ is changed to the second voltage higher than the first voltage. Thereafter, the common voltage $V_{SL}$ has the third voltage higher than the second voltage after a predetermined time has elapsed in the vertical blank period. The time duration for applying the second voltage and the time duration for applying the third voltage to the storage electrode line SL may be equally set to be equal to each other.

The times when the common voltage $V_{SL}$ is changed from the first voltage to the second voltage and changed from the second voltage to the third voltage may be set so as to coincide with a time when the voltage of one terminal of the storage capacitor Cst is discharged such that a pixel voltage may be changed from the originally applied data voltage to another voltage which is lower than the originally applied data voltage.

Subsequently, the vertical blank period ends, and the gate-off voltage is applied to the storage electrode control line SCL. Accordingly, the third switching element Q3 connected to the storage electrode control line SCL is turned on.

Simultaneously, the n+1 frame starts, and the gate-on voltage is applied to the gate line G. Accordingly, the first switching element Q1 and the second switching element Q2 are turned on. Subsequently, the data voltage is applied to the data line D, and the liquid crystal capacitor Clc and the storage capacitor Cst are charged. In this case, since the still image is displayed, the data voltages of the n-th frame and the n+1-th frame are the same as each other.

When the n+1-th frame starts, the common voltage $V_{SL}$ applied to the storage electrode line SL drops to the first voltage again and is transferred to the other terminal of the storage capacitor Cst through the second switching element.

As described above, the common voltage $V_{SL}$ applied to the storage electrode line SL has a value changed when the display panel is driven at the second frequency (for displaying a still image). That is, the common voltage $V_{SL}$ has the first voltage in the n-th frame and the n+1-th frame, the second voltage higher than the first voltage and the third voltage higher than the second voltage sequentially in the vertical blank period between the n-th frame and the n+1-th frame.

For example, the first voltage may be set to 7.5 V, the second voltage may be set to 7.6 V, and the third voltage may be set to 7.7 V.

The storage capacitor Cst includes a first terminal electrically connected to the switching element Q1; the storage capacitor further includes a second terminal connected between the first terminal and the storage line SL. The voltage of the second terminal of the storage capacitor Cst (which is electrically connected with the second switching element Q2 and the third switching element Q3) is changed according to the change of the common voltage $V_{SL}$. Further, the voltage of the first terminal of the storage capacitor Cst (which is electrically connected with the first switching element Q1) also is changed.

For example, if the voltage of the terminal of the storage capacitor Cst connected with the first switching element Q1 is 10.5 V in the n-th frame given the data voltage applied, when the first switching element Q1 has been turned off and when the predetermined time has elapsed, the voltage may drop.

When the voltage of the first terminal of the storage capacitor Cst drops to about 10.4 V in the vertical blank period and the third switching element Q3 is turned on, the common voltage $V_{SL}$ of 7.6 V is applied to the second terminal of the storage capacitor Cst. In this case, the voltage of the first terminal of the storage capacitor Cst also increases (according to the increase in the voltage of the second terminal of the storage capacitor Cst to be 10.5 V again.

When the predetermined time has elapsed and the voltage of the first terminal of the storage capacitor Cst drops to about 10.4 V, the common voltage $V_{SL}$ applied to the second terminal of the storage capacitor Cst may increase to 7.7 V. In this case, the voltage of the first terminal of the storage capacitor Cst also increases by the increase in the voltage of the second terminal of the storage capacitor Cst to be 10.5 V again.

Thereafter, when the n+1-th frame starts, the same data voltage as the data voltage in the n-th frame is applied to the first terminal of the storage capacitor Cst.

As described above, the voltage of the first terminal of the storage capacitor Cst may be changed in the vertical blank period through the change of the common voltage $V_{SL}$, such that luminance associated with the display panel is changed.

When a motion picture is displayed, the display panel is driven at a frequency relatively higher than when a still image is displayed, such that flicker is not conspicuous because the cycle of the luminance change is short. When a still image is displayed, the display panel is driven at a frequency relatively lower than when a motion picture is displayed, such that the flicker also is not conspicuous. In the embodiment of the present invention, the luminance change is introduced through the change in the common voltage $V_{SL}$, such that the flicker may not be conspicuous.

In an embodiment of the present invention, when a motion picture is displayed, since the flicker is not conspicuous even without luminance change, the common voltage $V_{SL}$ having a predetermined value is supplied to the storage electrode line SL.

As described above, when a still image is displayed, that is, when the display panel is driven at the second frequency, the common voltage $V_{SL}$ is changed from the first voltage to the second voltage and from the second voltage to the third voltage and returns to the first voltage again. However, the present invention is not limited thereto, and the change in the common voltage $V_{SL}$ may be implemented by various methods.

Figure 5:
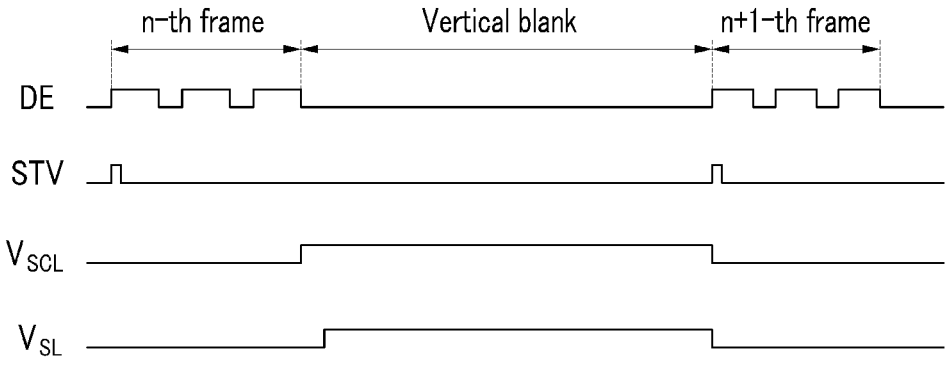
FIG. 5 is a diagram illustrating control signals for displaying a still image on a display panel of a display device according to an embodiment of the present invention.

For example, the common voltage $V_{SL}$ may be changed according to the example of FIG. 5.

FIG. 5 is a diagram illustrating control signals when a still image is displayed on a display panel of a display device according to an embodiment of the present invention.

When the display panel is driven at the second frequency, the common voltage $V_{SL}$ may have a first voltage in the n-th frame and the n+1-th frame and may have a second voltage higher than the first voltage in the vertical blank period between the n-th frame and the n+1-th frame. That is, the common voltage $V_{SL}$ may increase from the first voltage to the second voltage, may maintain at the second voltage, and may drop to the first voltage again when the next frame starts.

In one or more embodiments, when the display panel is driven at the second frequency, the common voltage $V_{SL}$ may have a first voltage in the n-th frame and the n+1-th frame and may have a second voltage higher than the first voltage in the vertical blank period between the n-th frame and the n+1-th frame. Subsequently, after a predetermined time duration has elapsed in the vertical blank period, the common voltage $V_{SL}$ may have the third voltage higher than the second voltage. After the predetermined time duration has elapsed again, the common voltage $V_{SL}$ may have the fourth voltage higher than the third voltage. That is, in the vertical blank period, the common voltage $V_{SL}$ is changed from the first voltage to the second voltage, from the second voltage to the third voltage, and from the third voltage to the fourth voltage; and when the next frame starts, the common voltage $V_{SL}$ may drop to the first voltage.

When the vertical blank period is relatively short, although the number of the voltage changes is set to be small, the flicker is not conspicuous. On the other hand, when the vertical blank period is relatively long, the flicker is may be more conspicuous; for improving image quality, the number of the voltage changes may be set to be larger, i.e., more voltage changes may be implemented.

Next, a display device according to an embodiment of the present invention will be described with reference to the accompany drawings.

In one or more embodiments, the second switching element, the third switching element, and the storage electrode control line are not implemented, as discussed with reference to the example of FIG. 6.

Figure 6:
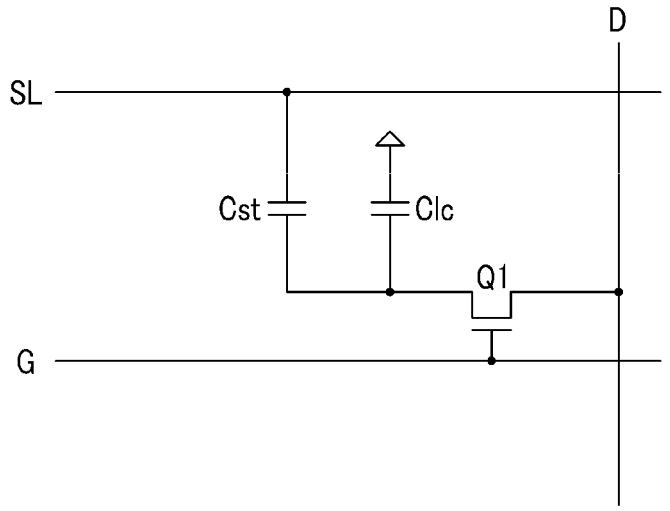
FIG. 6 is an equivalent circuit diagram for a pixel of a display device according to an embodiment of the present invention.

FIG. 6 is an equivalent circuit diagram for one pixel of a display device according to an embodiment of the present invention. Duplicated description and drawings may be omitted.

As shown in FIG. 6, a pixel is defined by crossing a gate line G and a data line D. The gate lines G and the data lines D may be in plural and the pixels may be in plural, but only one pixel is shown as an example in FIG. 6.

The pixel may include a switching element Q1 connected to both the gate line G and the data line D. The switching element Q1 is a three-terminal element such as a thin film transistor that includes a control terminal connected with the gate line G, an input terminal connected with the data line D, and an output terminal connected with a liquid crystal capacitor Clc and a storage capacitor Cst.

Further, a storage electrode line SL may be further formed, and the storage electrode line SL and the storage capacitor Cst are connected to each other. The storage capacitor Cst includes a first terminal electrically connected to the switching element Q1; the storage capacitor further includes a second terminal connected between the first terminal and the storage line SL.

The storage electrode line SL and the storage capacitor Cst are electrically connected to each other without being connected through a switching element.

Hereinafter, a voltage relationship when the still image is displayed on the display panel of the display device according to an embodiment of the present invention will be described below.

Figure 7:
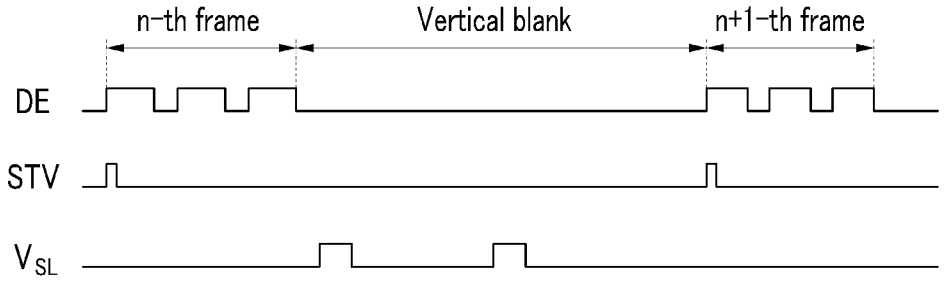
FIG. 7 is a diagram illustrating control signals for displaying a still image on a display panel of a display device according to an embodiment of the present invention.

FIG. 7 is a diagram illustrating each of control signals when a still image is displayed on a display panel of a display device according to an embodiment of the present invention, such as the embodiment illustrated in the example of FIG. 6.

In the display device, when a motion picture is displayed, the display panel is driven at a first frequency, and when a still image is displayed, the display panel is driven at a second frequency lower than the first frequency. In one or more embodiments, the length of a vertical blank period associated with the second frequency may be implemented to be larger than the length of a vertical blank period associated with the first frequency.

When a still image is displayed by driving the display panel at the second frequency, first, if gate-on voltage is applied to the gate line G in the n-th frame, the switching element Q1 is turned on. Next, if data voltage is applied to the data line D, the liquid crystal capacitor Clc and the storage capacitor Cst are charged through the first switching element Q1.

A first terminal of the storage capacitor Cst is connected with the switching element Q1 to receive the data voltage, and a second terminal thereof is connected with the storage electrode line SL to receive a common voltage $V_{SL}$ applied to the storage electrode line SL. For the n-th frame to which the data enable signal is applied, the common voltage $V_{SL}$ has a predetermined value.

After the data voltage is applied to each pixel, the gate-off voltage is applied to the gate line G, and the switching element Q1 is turned off. Subsequently, the vertical blank period starts, and the common voltage $V_{SL}$ is changed. The common voltage $V_{SL}$ in the vertical blank period swings a first voltage, which is equal to the common voltage $V_{SL}$ applied in the n-th frame, and a second voltage that is higher than the first voltage.

When the common voltage $V_{SL}$ in the n-th frame has the first voltage and the vertical blank period starts, the common voltage $V_{SL}$ may be changed to the second voltage higher than the first voltage and then, may drop to the first voltage again. Thereafter, after a predetermined time duration has elapsed in the vertical blank period, the common voltage $V_{SL}$ may be changed to the second voltage again and then, may drop to the first voltage again. In the vertical blank period, a time duration during which the common voltage $V_{SL}$ has the second voltage may be set to be shorter than a time duration during which the common voltage $V_{SL}$ has the first voltage.

A time when the common voltage $V_{SL}$ is changed from the first voltage to the second voltage may be set so as to coincide with a time when the voltage of the first terminal of the storage capacitor Cst (which is connected to the switching element Q1) is discharged such that the common voltage $V_{SL}$ may be different from originally applied data voltage by a predetermined voltage or by more than the predetermined voltage.

In FIG. 7, the number of times of the case where the common voltage $V_{SL}$ is changed from the first voltage to the second voltage in the vertical blank period between two adjacent frames and then, returns to the first voltage again is two times. However, the present invention is not limited thereto and the number of times may be variously set. For example, the number of times of the case where the common voltage $V_{SL}$ is changed from the first voltage to the second voltage in the vertical blank period between two adjacent frames and then, returns to the first voltage again may be set to be only one time and set to be three times, four times, or the like.

When the vertical blank period is relatively short, although the number of the voltage changes is set to be small, the flicker is not conspicuous. On the other hand, when the vertical blank period is relatively long, the flicker may be more conspicuous; for improving image quality, the number of the voltage changes may be set to be larger. In one or more embodiments, the common voltage have a first amount of change occurrences associated with a first vertical blank period length and a second amount of change occurrences associated with a second vertical blank period length, wherein the second vertical blank period length is longer than the first vertical blank period length, and the second amount of change occurrences is set to be more than the first amount of change occurrences.

Subsequently, the vertical blank period ends, and the common voltage $V_{SL}$ applied to the storage electrode line SL is maintained constant at the first voltage.

Simultaneously, the n+1-th frame starts and the gate-on voltage is applied to the gate line G. Accordingly, the switching element Q1 is turned on. Subsequently, the data voltage is applied to the data line D, and the liquid crystal capacitor Clc and the storage capacitor Cst are charged. In this case, since a still image is displayed, the data voltages of the n-th frame and the n+1-th frame are the same as each other.

As described above, the common voltage $V_{SL}$ applied to the storage electrode line SL has a value changed when the display panel is driven at the second frequency for displaying a still image. That is, the common voltage $V_{SL}$ has the first voltage between the n-th frame and the n+1-th frame and swings between the first voltage and the second voltage (higher than the first voltage) in the vertical blank period between the n-th frame and the n+1-th frame. For example, the first voltage may be set to 7.5 V, and the second voltage may be set to 7.6 V.

The storage capacitor Cst includes a first terminal electrically connected to the switching element Q1; the storage capacitor further includes a second terminal connected between the first terminal and the storage line SL. The voltage of the second terminal of the storage capacitor Cst (which is electrically connected with the storage electrode line SL) is changed according to the change in the common voltage $V_{SL}$. Further, the voltage of the first terminal of the storage capacitor Cst (which is electrically connected with the switching element Q1) also is changed.

For example, if the voltage of the first terminal of the storage capacitor Cst (which is connected with the first switching element Q1) is 10.5 V in the n-th frame given that the data voltage applied, when the switching element Q1 has been turned off and when the predetermined time duration has elapsed, the voltage may drop to 10.4 V.

When the common voltage $V_{SL}$ inputted to the storage electrode line SL increases from 7.5 V to 7.6 V, the voltage of the second terminal of the storage capacitor Cst increases to 7.6 V. In this case, the voltage of the first terminal of the storage capacitor Cst also increases by the increase in the voltage of the second terminal of the storage capacitor Cst and becomes 10.5 V again. Subsequently, the common voltage $V_{SL}$ drops to 7.5 V again.

When the predetermined time duration has elapsed and the voltage of the first terminal of the storage capacitor Cst drops to about 10.4 V, the common voltage $V_{SL}$ applied to the second terminal of the storage capacitor Cst may increase from 7.5 V to 7.6 V. In this case, the voltage of the first terminal of the storage capacitor Cst also increases by the increase in the voltage of the second terminal of the storage capacitor Cst and becomes 10.5 V again.

Thereafter, when the n+1-th frame starts, the same data voltage as the data voltage in the n-th frame is applied to the first terminal of the storage capacitor Cst.

As described above, the voltage of the first terminal of the storage capacitor Cst may be changed through the change in the common voltage $V_{SL}$ in the vertical blank period and accordingly, the cycle of the luminance change associated with the display panel is shortened, such that the flicker may not be conspicuous.

As described above, the common voltage $V_{SL}$ instantaneously increases from the first voltage to the second voltage and then, instantaneously decreases from the second voltage to the first voltage again after the predetermined time duration has elapsed. However, the present invention is not limited thereto and change forms of the common voltage $V_{SL}$ may be implemented by various methods.

Figure 8:
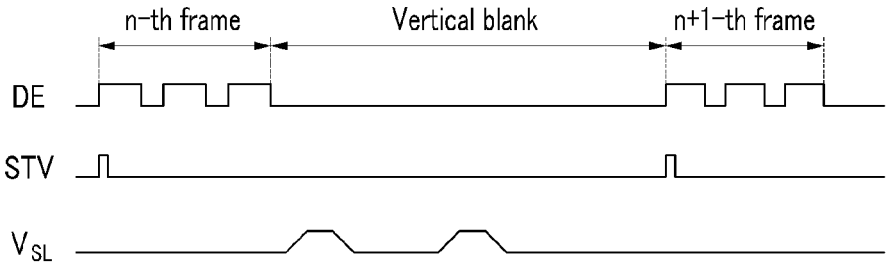
FIG. 8 is a diagram illustrating control signals for displaying a still image on a display panel of a display device according to an embodiment of the present invention.

For example, as shown in FIG. 8, the common voltage $V_{SL}$ may be changed.

FIG. 8 is a diagram illustrating control signals when a still image is displayed on a display panel of a display device according to an embodiment of the present invention.

When the display panel is driven at a second frequency for display a still image (wherein the second frequency is lower than a first frequency used for displaying a motion picture), the common voltage $V_{SL}$ may have a first voltage in the n-th frame and the n+1-th frame and may swing between the first voltage and a second voltage higher than the first voltage in the vertical blank period between the n-th frame and the n+1-th frame. In this case, when the common voltage $V_{SL}$ is changed from the first voltage to the second voltage, the common voltage $V_{SL}$ may be gradually changed while having one or more values between the first voltage and the second voltage. Further, when the common voltage $V_{SL}$ is changed from the second voltage to the first voltage, the common voltage $V_{SL}$ may be gradually changed while having one or more values between the first voltage and the second voltage.

In one or more embodiments, when the common voltage $V_{SL}$ is changed from the first voltage to the second voltage, the common voltage $V_{SL}$ may be gradually changed while having one or more values between the first voltage and the second voltage, and when the common voltage $V_{SL}$ is changed from the second voltage to the first voltage, the common voltage $V_{SL}$ may instantaneously drop from the second voltage to the first voltage. In one or more embodiments, when the common voltage $V_{SL}$ is changed from the first voltage to the second voltage, the common voltage $V_{SL}$ may instantaneously increase from the first voltage to the second voltage, and when the common voltage $V_{SL}$ is changed from the second voltage to the first voltage, the common voltage $V_{SL}$ may be gradually change while having one or more values between the first voltage and the second voltage.

Hereinafter, power consumption reduced in the display device according to the embodiments of the present invention will be described.

Figure 9:
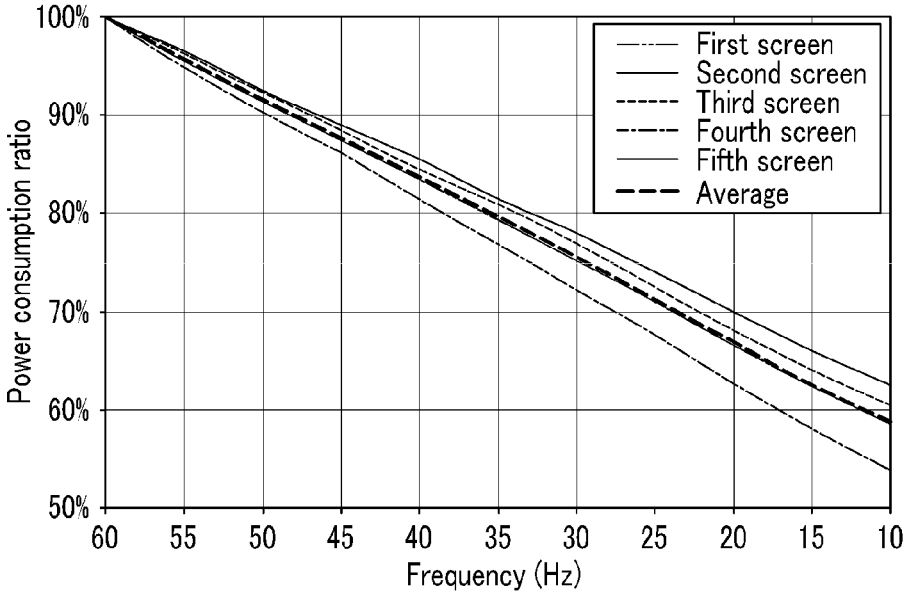
FIG. 9 is a graph illustrating power consumption ratio values corresponding to driving frequency values according to an embodiment of the present invention.

FIG. 9 is a graph illustrating power consumption according to a driving frequency. In detail, if the power consumption in the driving frequency of 60 Hz is 100% and five different screens are driven at 60 Hz to 10 Hz, a ratio of relative power consumption to the power consumption in the driving of 60 Hz is shown. Further, an average for the ratios of the power consumption of five different screens also is shown. In the five different screens, the first screen is a white screen, the second screen is a black screen, the third screen and the fourth screen are screens displaying different colors by dividing the entire area into a plurality of regions, and the fifth screen is a screen wallpaper.

Since the power consumption when the display panel is driven at 10 Hz is about 60%, the power consumption is reduced by about 40% as compared with the case where the display panel is driven at 60 Hz. In one or more embodiments, the driving frequency for displaying still images is set to be lower than the driving frequency for displaying motion pictures. As a result, the reduced power consumption may be greater than the increased power consumption required for the addition of the frame memory. Advantageously, a net reduction of power consumption may be achieved.

When a motion picture is displayed, if the driving frequency is reduced, there is a problem in that the motion may look unsmooth and/or awkward. On the other hand, when a still image is displayed, since frames having the same image data are reproduced, although the driving frequency is reduced, the problem does not occur.

Nevertheless, when the display panel is driven at a low driving frequency, flicker may be conspicuous. Embodiments of the invention may further prevent the issue of conspicuous flicker.

Figure 10:
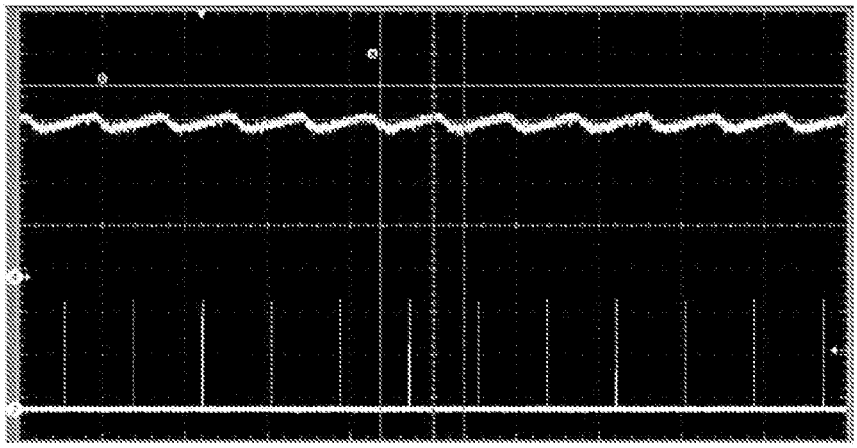
FIG.10 (Prior Art)
FIG. 10 is a graph illustrating the voltage at a terminal of a storage capacitor when a display panel according to an embodiment of the present invention is driven at 60 Hz.
Figure 11:
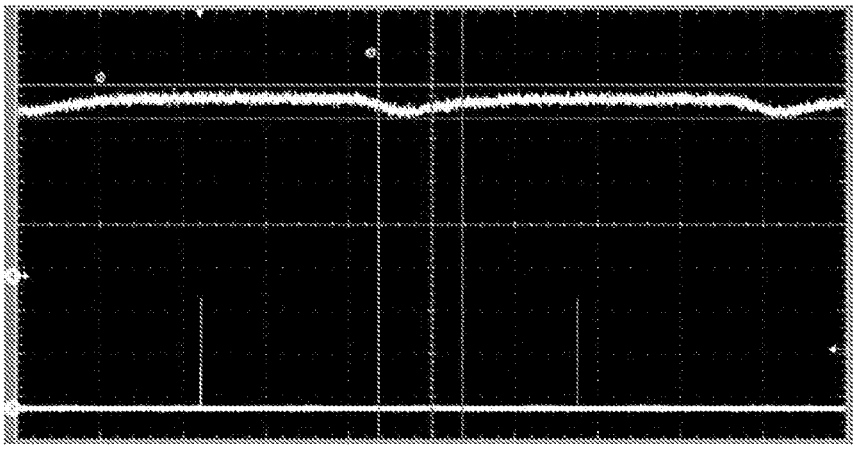
FIG.11 (Prior Art)
FIG. 11 is a graph illustrating the voltage at a terminal of a storage capacitor when a display panel according to an embodiment of the present invention is driven at 10 Hz.
Figure 12:
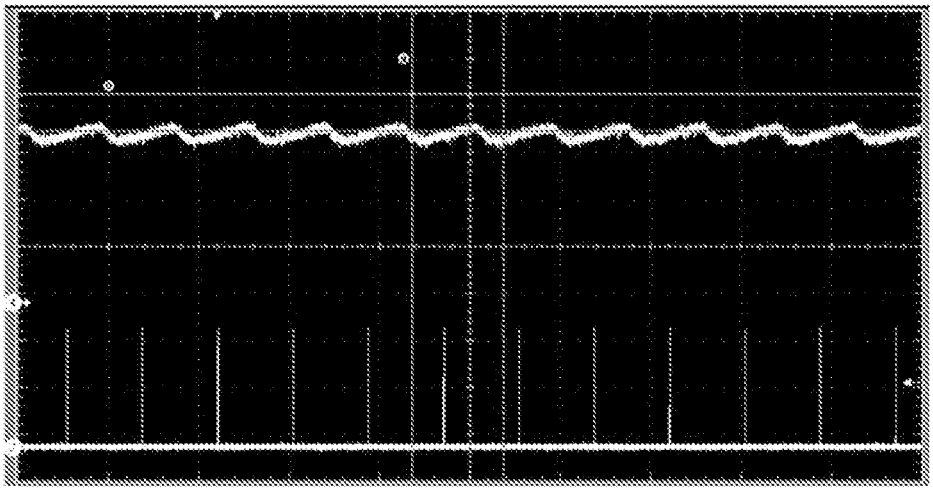
FIG. 12 is a graph illustrating the voltage at a terminal of a storage capacitor when a display panel according to an embodiment of the present invention is driven at 10 Hz.

FIG. 10 is a graph illustrating voltage of a terminal of a storage capacitor when a known display panel is driven at 60 Hz, FIG. 11 is a graph illustrating voltage of the terminal of a storage capacitor when a known display panel is driven at 10 Hz, and FIG. 12 is a graph illustrating voltage of a terminal of a storage capacitor when a display panel according to an embodiment of the present invention is driven at 10 Hz.

Comparing FIG. 10 and FIG. 11, when the display panel is driven at 10 Hz, the cycle of voltage change in the terminal of the storage capacitor is lengthened as compared with the case where the display panel is driven at 60 Hz, such that the cycle of luminance change is lengthened. Accordingly, as the driving frequency becomes lower, the flicker is conspicuous. Referring to FIG. 12, in an embodiment of the present invention, when a still image is displayed at the low driving frequency, the common voltage is changed, and the cycle of voltage change in the terminal of the storage capacitor may be shortened to substantially the level when the display panel is driven at 60 Hz. Accordingly, the cycle of luminance change is shortened, such that the flicker may be inconspicuous.

While this invention has been described in connection with what is presently considered to be practical embodiments, it is to be understood that the invention is not limited to the disclosed embodiments, but is intended to cover various modifications and equivalent arrangements included within the spirit and scope of the appended claims.

What is claimed is:

1. A display device comprising:

a display panel for displaying a still image and for displaying a motion picture, the display panel including a gate line, a data line, a storage electrode line, a first switching element connected to the gate line and the date line, and a storage capacitor connected to the switching element and the storage electrode line;

a signal controller for providing controlling signals to drive the display panel, wherein the display panel is driven at a first frequency when the motion picture is displayed, the display panel is driven at a second frequency lower than the first frequency when the still image is displayed, and when the display panel is driven at the second frequency, a common voltage inputted to the storage electrode line has a first voltage value in a first period and has a second voltage unequal to the first voltage value in a second period.

2. The display device of claim 1, further comprising a graphic processing unit for transmitting a still image start signal to the signal controller and for transmitting a still image end signal to the signal controller.

3. The display device of claim 2, wherein:

the signal controller includes a frame memory for storing a first set of input image data transmitted from the graphic processing unit as stored image data, the signal controller outputs the stored image data to the display panel at the second frequency, and the signal controller inactivates transmission of further input image data when the signal controller receives the still image start signal.

4. The display device of claim 3, wherein:

the signal controller activates transmission of a second set of input image data and outputs the second set of input image data to the display panel at the first frequency when the signal controller receives the still image end signal.

5. The display device of claim 1, wherein:

the display panel further includes a second switching element and a third switching element connected between the storage electrode line and the storage capacitor; and a storage electrode control line, wherein each of the second switching element and the third switching element includes a control terminal, an input terminal, and an output terminal, the input terminals of the second switching element and the third switching element are connected to the storage electrode line, the output terminals of the second switching element and the third switching element are connected to the storage capacitor, the control terminal of the second switching element is connected to the gate line, and the control terminal of the third switching element is connected to the storage electrode control line.

6. The display device of claim 1, wherein:

the first period precedes the second period, and the second voltage value is higher than the first voltage value.

7. The display device of claim 6, wherein:

the first period corresponds to a frame, and the second period corresponds to a vertical blank period between two adjacent frames.

8. The display device of claim 7, wherein:

a control voltage inputted to the storage electrode control line has a gate-off voltage value in the first period and has a gate-on voltage value in the second period.

9. The display device of claim 6, wherein:

when the display panel is driven at the second frequency, the common voltage has a third voltage value higher than the second voltage value in a third period.

10. The display device of claim 9, wherein:

the first period corresponds to a frame, and the second period and the third period are within a time period that corresponds to a vertical blank period between two adjacent frames.

11. The display device of claim 6, wherein:

when the display panel is driven at the second frequency, the common voltage changes from having the first voltage value to having the second voltage value in the second period and changes from having the second voltage value to having the first voltage value in the second period.

12. The display device of claim 11, wherein:

the common voltage gradually changes from having the first voltage value to having the second voltage value, and the common voltage has a value between the first voltage value and the second voltage value.

13. A method for driving a display device, the method comprising:

receiving a first set of input image data;

driving a display panel at a first frequency;

receiving a still image start signal;

after the receiving the still image start signal, driving the display panel at a second frequency lower than the first frequency;

providing a common voltage to the display panel, wherein when the display panel is driven at the second frequency, the common voltage has a first voltage value in a first period and has a second voltage unequal to the first voltage value in a second period;

receiving a still image end signal; and after the receiving the still image end signal, driving the display panel at the first frequency.

14. The driving method of a display device of claim 13, further comprising:

storing the first set of input image data in a frame memory as stored image data;

after the receiving the still image start signal, inactivating transmission of further input image data; and after the receiving the still image start signal, outputting the stored image data stored to the display panel at the second frequency.

15. The driving method of a display device of claim 14, further comprising:

after the receiving the still image end signal, activating transmission of second set of input image data; and after the receiving the still image end signal, outputting the second set of input image data to the display panel at the first frequency.

16. The driving method of a display device of claim 13, wherein:

the first period precedes the second period, and the second voltage value is higher than the first voltage value.

17. The driving method of a display device of claim 16, wherein:

the first period corresponds to a frame, and the second period corresponds to a vertical blank period between two adjacent frames.

18. The driving method of a display device of claim 16, wherein:

the common voltage has a third voltage value higher than the second voltage value in a third period.

19. The driving method of a display device of claim 16, wherein:

the common voltage changes from having the first voltage value to having the second voltage in a second period and changes from having the second value to having the first value in the second period.

20. The driving method of a display device of claim 19, wherein:

the common voltage gradually changes from having the first voltage value to having the second voltage value, and the common voltage has a value between the first voltage value and the second voltage value.

* * * * *